US009147383B2

(12) United States Patent
Kairis et al.

(10) Patent No.: US 9,147,383 B2
(45) Date of Patent: Sep. 29, 2015

(54) COVER FOR STRIKING DEVICE FOR PERCUSSION INSTRUMENT

(76) Inventors: Paul R. Kairis, Crest Hill, IL (US); Salvatore DiStefano, Chicago, IL (US)

( * ) Notice: Subject to any disclaimer, the term of this patent is extended or adjusted under 35 U.S.C. 154(b) by 49 days.

(21) Appl. No.: 13/463,518

(22) Filed: May 3, 2012

(65) Prior Publication Data

US 2012/0279379 A1 Nov. 8, 2012

Related U.S. Application Data

(60) Provisional application No. 61/482,025, filed on May 3, 2011.

(51) Int. Cl.
*G10D 13/02* (2006.01)
*G10D 13/00* (2006.01)

(52) U.S. Cl.
CPC ..... *G10D 13/003* (2013.01)

(58) Field of Classification Search
CPC ..... G10D 13/003
USPC ..... 84/422.4; D17/22
See application file for complete search history.

(56) References Cited

U.S. PATENT DOCUMENTS

| | | | | | |
|---|---|---|---|---|---|
| 2,083,684 | A | * | 6/1937 | Burke | 2/168 |
| 3,916,448 | A | * | 11/1975 | Hamel | 2/2.5 |
| 4,632,006 | A | * | 12/1986 | Ambroszewski | 84/422.4 |
| 4,681,012 | A | * | 7/1987 | Stelma et al. | 84/422.4 |
| 5,263,395 | A | * | 11/1993 | Phillips | 84/422.4 |
| 5,361,617 | A | | 11/1994 | Dittlo | |
| 5,361,671 | A | * | 11/1994 | Genna | 84/422.4 |
| 6,307,138 | B1 | * | 10/2001 | Simpson | 84/422.4 |
| 6,326,535 | B1 | | 12/2001 | Pokallus | |
| 7,439,434 | B1 | | 10/2008 | Cole et al. | |
| 2007/0151421 | A1 | | 7/2007 | Schroder | |
| 2007/0245880 | A1 | | 10/2007 | Perkins | |
| 2009/0072455 | A1 | | 3/2009 | McPherson | |

OTHER PUBLICATIONS

ISR and WO dated Aug. 7, 2012, from PCT Application No. PCT/US12/36350.

* cited by examiner

*Primary Examiner* — Jianchun Qin
(74) *Attorney, Agent, or Firm* — Banner & Witcoff, Ltd.

(57) ABSTRACT

A cover system for a percussion striking device allows drummers and percussionists to removably cover their existing sticks, mallets, and beaters of their preference with a light weight, durable fabric to produce benefits including: reducing volume during practice sessions, resulting in less ear fatigue, maintaining as true of a response as possible ("feel") of the playing surface while working techniques used to enhance actual performance, and/or reducing wear on drumsticks, mallets, and beaters and all playing surfaces it is used on, as well as other benefits.

10 Claims, 8 Drawing Sheets

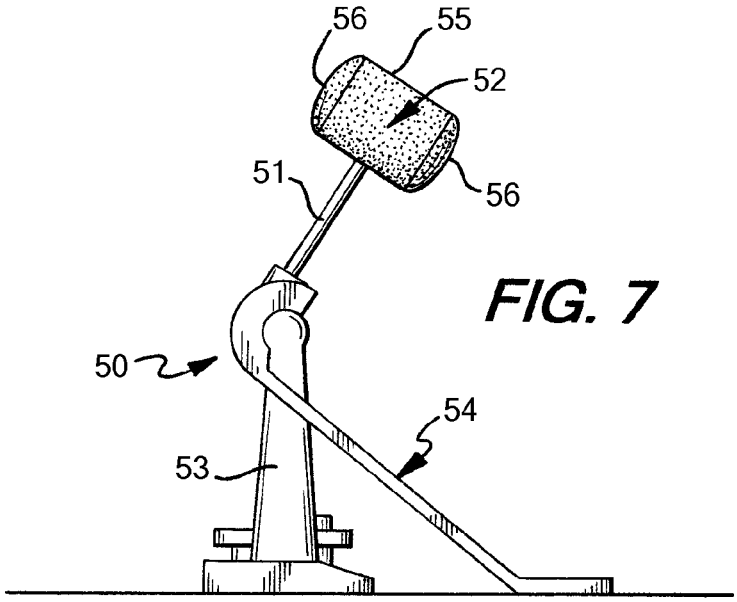
FIG. 7
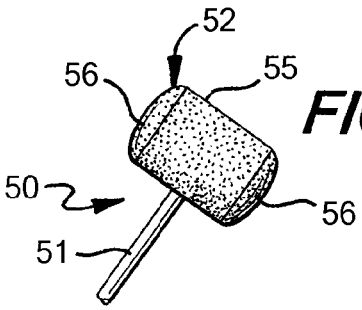
FIG. 8
FIG. 9
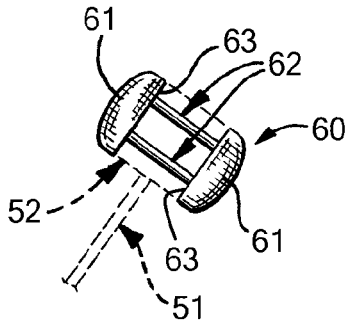
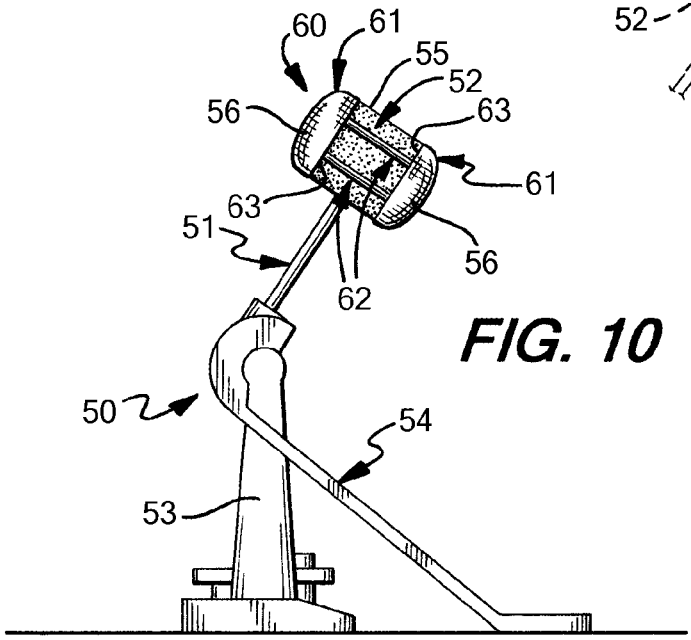
FIG. 10

FIG. 27A
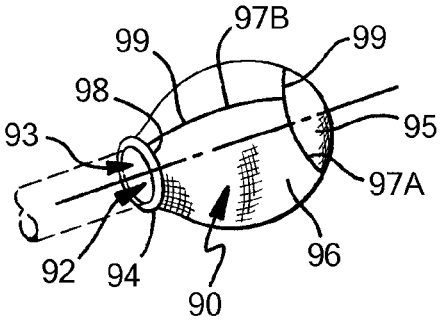
FIG. 27B
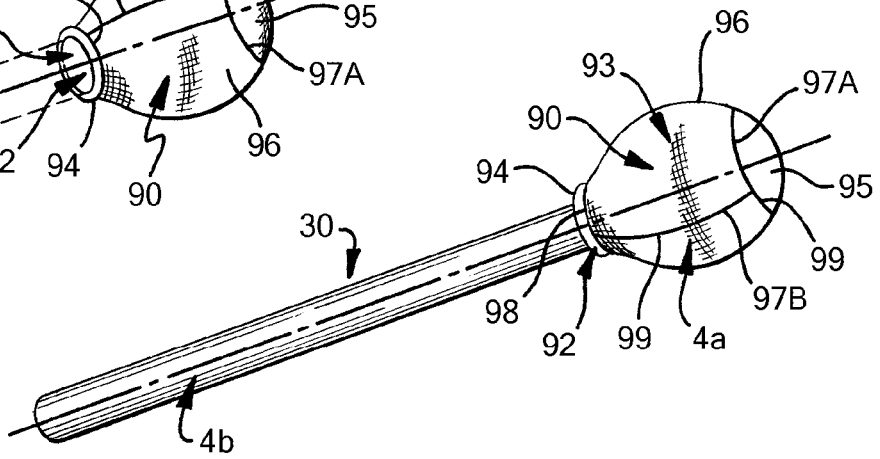
FIG. 29
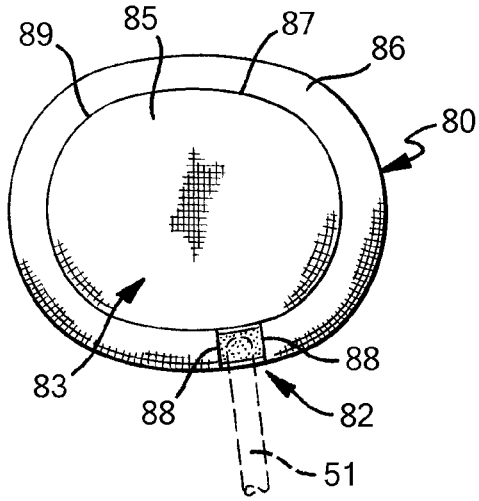
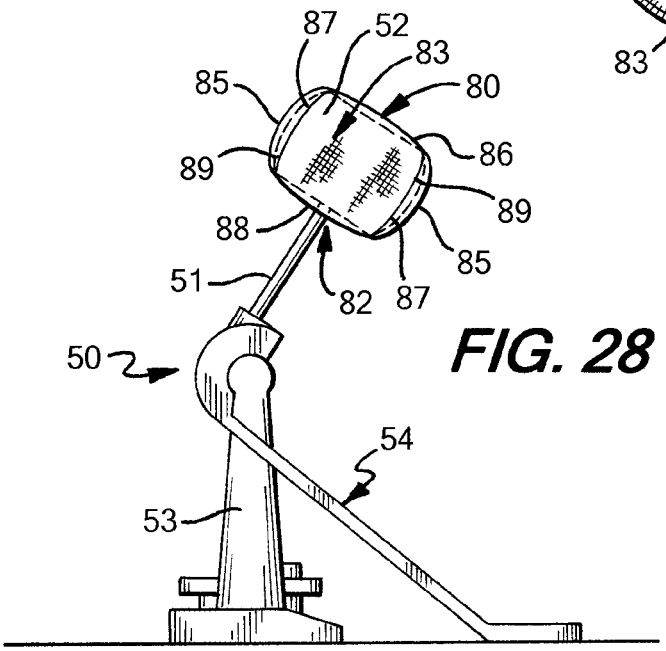
FIG. 28

COVER FOR STRIKING DEVICE FOR PERCUSSION INSTRUMENT

CROSS-REFERENCE TO RELATED APPLICATION

This application claims priority to and the benefit of U.S. Provisional Application Ser. No. 61/482,025, filed May 3, 2011, which prior application is incorporated by reference herein in its entirety and made part hereof.

TECHNICAL FIELD

The invention relates generally to covers for striking devices for use in striking percussion instruments. Certain aspects of this invention relate to a flexible, removable cover that can be positioned over at least a striking tip of a percussion striking device.

BACKGROUND

Drummers and other percussionists often practice and work on their technique to improve at playing their desired instruments. Percussionists (like all instrumentalists) also often practice a piece of music repetitively until it is ready to be performed. Many percussionists are very particular about the size, shape, weight, feel, balance, and response of the drumstick, mallet, beater, or other striking device they choose to use in a given performance for optimum feel and satisfaction in sound quality. Percussionists may find their practices to be more effective when they are using a striking device that has the same size, shape, weight, feel, balance, and response as the striking device they use to play music in their performances. However, practicing can often pose problems for a percussionist. As one example, percussion instruments often produce loud and/or sharp noises that can be an unwelcome distraction to family, neighbors, and other people in the vicinity. These noises can also damage the hearing of the percussionist over time. As another example, repeated practice with the same striking device can cause wear and damage to the striking device and/or the instrument, even to the point of breakage. As a further example, practicing by striking certain surfaces, such as a table or desk top, can damage the surfaces.

Existing striking devices and accessories do not adequately address these issues. For example, percussion sticks designed for practicing currently exist, however such practice sticks typically do not have the same characteristics as the percussionist's preferred sticks. As another example, percussion sticks have been coated at least partially with rubber or similar material to reduce playing volume and/or to provide protection. However, such coatings are permanent, preventing the sticks from being used in normal performances, and may also add significant weight to the sticks. As another example, percussionists may cover the instrument itself with a covering, such as a towel or a specially-designed instrument cover. Such coverings dampen the response of the instrument, however, and do not permit the percussionist to feel the response of the instrument accurately.

The present device and method are provided to address the problems discussed above and other problems, and to provide advantages and aspects not provided by prior percussion striking devices, instruments, and accessories. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to a cover for a percussion striking device having a shaft and a striking portion configured for striking a percussion instrument. The cover includes a body defining an internal cavity with an opening providing access to the internal cavity, where the cover is configured to be removably connected to the percussion striking device such that at least a portion of the percussion striking device is received within the internal cavity through the opening and the striking portion is covered by the body. The body may be made of a multi-layer flexible material including a smooth fabric layer on an inner surface facing the internal cavity, a durable fabric layer on an outer surface opposite the inner surface, and a flexible cushioning layer between the smooth fabric layer and the durable fabric layer. The body may also be formed of one or more pieces of the flexible material stitched together along at least one seam to define the internal cavity. The cover is configured to be removed from the percussion striking device by removing the at least a portion of the percussion striking device from the internal cavity by passing the percussion striking device through the opening. The body may also be configured to cover at least a portion of the shaft of the device.

According to one aspect, the flexible cushioning layer includes a compressible polymer material (e.g. an elastomeric material and/or a material with a foam or other cellular structure), the smooth fabric layer includes a light nylon fabric, and the durable fabric layer includes a heavy nylon material (e.g. Cordura or other heavy nylon material).

Additional aspects of the invention relate to a cover for a percussion striking device having a shaft and a striking portion configured for striking a percussion instrument. The cover includes a body made of a flexible material and defining an internal cavity, where the cover is configured to be removably connected to the percussion striking device such that at least a portion of the percussion striking device is received within the internal cavity and the striking portion is covered by the flexible material.

According to one aspect, the flexible material is a multi-layer material including a smooth fabric layer on an inner surface facing the internal cavity, a durable fabric layer on an outer surface opposite the inner surface, and a flexible cushioning layer between the smooth fabric layer and the durable fabric layer. The flexible cushioning layer may include a compressible polymer material (e.g. an elastomeric material and/or a material with a foam or other cellular structure or another sound absorbent and/or energy absorbent material. The three-layer material may have a thickness of between about 1-3 mm.

According to another aspect, the body is formed of a sleeve having an opening for access to the internal cavity, and the cover is configured to be removably connected to the percussion striking device by inserting the at least a portion of the percussion striking device through the opening and into the internal cavity. The cover may have an elastic portion around the opening that permits the opening to expand to be configured to receive an enlarged head of the percussion striking device therethrough.

According to a further aspect, the body includes a first piece and a second piece that are separate from each other and are connected by at least one elastic strap, wherein the cover is configured to be connected to an enlarged head of the percussion striking device such that the first and second pieces are positioned on opposite sides of the head. The first and second pieces may be cup-shaped and each have an internal cavity configured to receive a portion of the head of the percussion striking device.

According to yet another aspect, the cover is configured to be removed from the percussion striking device by removing the portion(s) of the percussion striking device from the internal cavity.

According to still a further aspect, the body may have at least one customizable graphic feature.

Further aspects of the invention relate to an assembly that includes a percussion striking device having a shaft and a striking portion configured for striking a percussion instrument, and a cover as described above being removably connected to the percussion striking device such that at least a portion of the percussion striking device is received within the internal cavity and the striking portion is covered by the body.

According to one aspect, the percussion striking device further includes a second striking portion, and the assembly further includes a second cover. The second cover includes a second body made of the flexible material and defining a second internal cavity, the second cover being removably connected to the percussion striking device such that at least a second portion of the percussion striking device is received within the second internal cavity and the second striking portion is covered by the second body.

Still further aspects of the invention relate to a kit or assembly that includes two covers as described above, both configured for removable connection to a percussion striking device to cover two different striking portions of the percussion striking device.

Other aspects of the invention relate to methods that include connecting a cover or covers as described above to a percussion striking device.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which:

FIG. 7 is a side view of another illustrative embodiment of an existing percussion striking device;

FIG. 8 is a side view of a head of the percussion striking device of FIG. 7;

FIG. 9 is a side view of another illustrative embodiment of a cover for a percussion striking device according to aspects of the present invention, disposed on the striking device of FIG. 7;

FIG. 10 is a side view of the cover of FIG. 9 disposed to cover at least a portion of the head of the percussion striking device as shown in FIG. 8;

FIG. 27A is a perspective view of another illustrative embodiment of a cover for a percussion striking device according to aspects of the present invention, configured for use with the striking device of FIG. 4;

FIG. 27B is a perspective view of the cover of FIG. 27A disposed on the percussion striking device of FIG. 4;

FIG. 28 is a side view of another illustrative embodiment of a cover according to aspects of the present invention, disposed to cover at least a portion of the head of the percussion striking device as shown in FIG. 8;

FIG. 29 is a bottom-front perspective view of the cover of FIG. 28;

It is understood that the relative sizes of the components in these Figures may be exaggerated in order to show relevant detail.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

In general, aspects of the invention relate to a cover for use with a percussion striking device, which can be disposed on and/or attached to the striking device to cover at least a portion of the striking device and is removable from the striking device. In one exemplary embodiment, the cover is configured to cover a striking portion of the percussion striking device that is configured for striking the percussion instrument. As used herein, a "percussion striking device" or "striking device" refers to any device configured for use in striking a percussion instrument, including drumsticks or other sticks, mallets, beaters, etc. Such striking devices can be configured for use in striking any type of percussion instrument, including pitched/tuned or untuned instruments, such as various membranophones (e.g. drums), cymbals, chimes, bells, keyed instruments (e.g. xylophone, marimba, glockenspiel, etc.), unconventional instruments (e.g. buckets), etc. It is understood that many percussion striking devices may be used in pairs.

Figure 1:
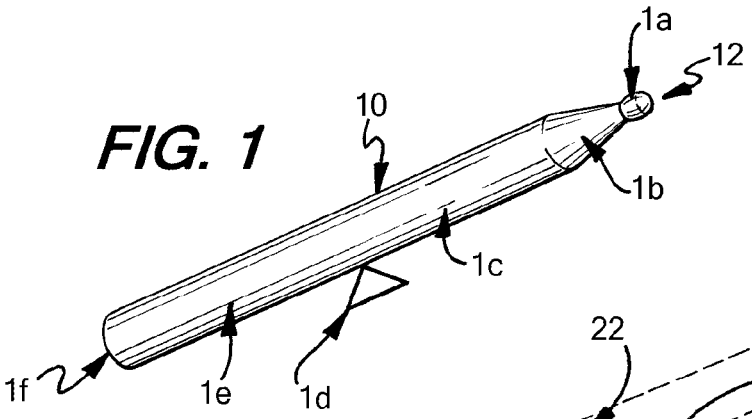
FIG. 1 is a side view of an illustrative embodiment of an existing percussion striking device.

Referring now to the Figures, and initially to FIG. 1, there is shown a percussion striking device 10 in the form of a drumstick. The device 10 generally includes a shaft 11 with a head or striking portion 12 disposed on one end of the shaft 11. The head 12 has a narrowed tip 1*a*, and is configured for striking a percussion instrument. The device 10 has a butt if opposite the tip 1*a*, with the shaft having a neck 1*c* and a grip portion 1*e* configured for gripping by the percussionist. A shoulder 1*b* narrows the cross-section of the device 10 from the neck 1*c* to the tip 1*a*. The device 10 also has a balance point 1*d* that may be proximate the center of gravity of the device 10. Generally, the shaft 11 and the head 12 are formed of rigid materials in this embodiment.

Figure 2:
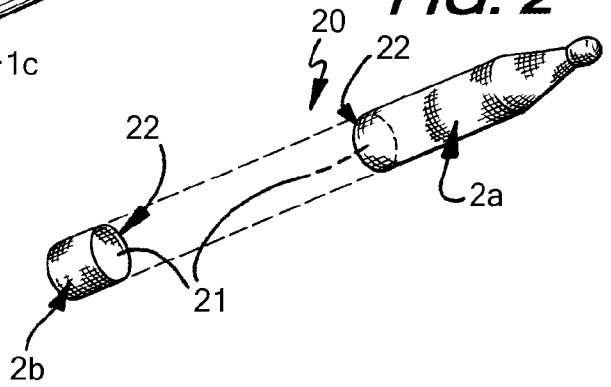
FIG. 2 is a side view of an illustrative embodiment of a cover for a percussion striking device according to aspects of the present invention, configured for use with the striking device of FIG. 1.
Figure 3:
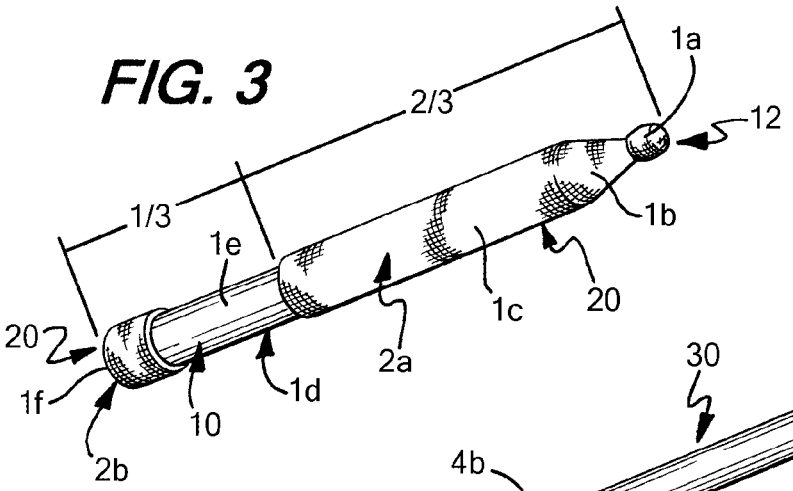
FIG. 3 is a perspective view of the cover of FIG. 2 disposed on the percussion striking device of FIG. 1.

FIG. 2 illustrates one embodiment of a cover 20 configured to be used in connection with the device 10 of FIG. 1, and FIG. 3 illustrates the cover 20 disposed on the device 10 of FIG. 1. This embodiment of the cover 20 includes a front piece 2*a* for covering a portion of the device 10 including the head 12, and a rear piece 2*b* for covering the butt 1*f*. The front piece 2*a* and the rear piece 2*b* may alternately be considered to be two different covers as described herein. In this embodiment, the cover 20 has a body that takes the form of a sleeve of material that includes an internal cavity or cavities 21 configured to receive a portion or portions of the device 10 therein. Both the front piece 2*a* and the back piece 2*b* have openings 22 leading to the respective internal cavities 21. The front piece 2*a* in this embodiment covers the entire head 12 including the tip 1*a*, and also covers the shoulder 1*b* and at least a portion of the neck 1*c*. As shown in FIG. 3, in this embodiment, the front piece 2*a* covers approximately ⅔ of the length of the device 10. Both pieces 2*a*, 2*b* of the cover 20 in this embodiment are fitted closely to the device 10 to provide friction to secure the cover 20 to the device 10. The grip portion 1*e* and the balance point 1*d* of the device 10 are left uncovered, to permit the percussionist to grip the device 10 as he/she normally would during actual playing/performance. In other embodiments, the front piece 2*a* and/or the rear piece 2*b* may cover a different portion of the device 10, and the grip portion 1*e* and/or the balance point 1*d* may be covered by the front piece 2*a* and/or the rear piece 2*b*. It is understood that the cover 20 or a similar cover can be used in connection with other drumsticks or other percussion striking devices having similar shapes, designs, and/or dimensions as the device 10 of FIGS. 1-3.

The front piece 2*a* of the cover 20 provides a soft and/or resilient surface on the head 12 that can absorb sound and/or energy to reduce or muffle sound created when striking a percussion instrument, such as a drum. This permits a percussionist to practice for long periods of time without creating excessive noise that may distract others and/or damage the percussionist's hearing. The cover 20 also resists wear and damage to the device 10 and/or the percussion instrument, and permits the percussionist to strike surfaces other than a percussion instrument (e.g. a desk or table top) without damaging the surface or the device 10. Further, the cover 20 permits the percussionist to practice with his/her preferred striking device to be used in performances. The cover 20 can be made of a light-weight material that does not significantly affect the weight or balance of the device 10, allowing the percussionist to experience the accurate feel and balance of the device 10 during practice using the cover 20. The gap in the cover 20 that leaves the grip portion 1*e* uncovered also assists with transmitting accurate feel to the percussionist. Still further, the cover 20 does not significantly affect the response of the device 10 when striking the chosen percussion instrument, allowing the percussionist to experience the accurate response that would occur during performance using the instrument. These benefits can be useful in all types of practicing, including when practicing new or unfamiliar striking techniques, where experiencing the accurate balance, feel, and response of the device 10 can enhance development and improvement. The cover 20 is designed so that it can be removed from the device 10 when normal playing of the instrument is desired, such as for performances. The skills developed using the cover 20 will translate well to playing with the uncovered device, for the reasons described above. Still other benefits and advantages are readily recognizable to those skilled in the art.

The rear piece 2*b* similarly protects the butt if of the device 10, in case the percussionist wishes to strike the instrument using the butt 1*f* rather than the head 12 (as in the case where a "back stick" stroke is used and the butt 1*f* also becomes a striking portion). The rear piece 2*b* may also provide some weight balance, depending on the weight of the material used for the cover 20. In other embodiments, the rear piece 2*b* may be omitted. It is understood that other portions of the device 10 may be considered to be striking portions, such as the shaft 11, as described below in connection with FIGS. 34 and 35.

The cover 20 may be made from a variety of different materials, or a combination of materials. In one embodiment, the cover 20 may be made of a material that is light weight and has at least some degree of elasticity, allowing the cover 20 to stretch to allow the device 10 to be inserted into the cover 20 and to also provide some grip or friction on the device 10 once it is inserted. In another embodiment, the cover 20 may additionally or alternately include a fastening mechanism, such as a strap, a fastener (button, snap, etc.), a drawstring, a zipper, a clamp, or other such fastening mechanism. In a further embodiment, the cover 20 may include a friction-enhancing material on the inside, to enhance gripping of the cover 20 onto the device 10. Such a friction-enhancing material may include a gripping substance, such as an adhesive, or a surface treatment on the inside of the cover 20 to increase the friction, such as through roughening the surface or making the surface tacky. In yet another embodiment, the cover 20 may include a rigid portion and may additionally include an elastic portion.

In the embodiment shown in FIG. 1, the cover 20 is made from a neoprene material, and may have a nylon or spandex backing on one or both surfaces. The cover 20 may have a material thickness of 1-3 mm. Other examples of materials that can be used for the cover 20 include various polymers and copolymers, including polyurethanes, silicones, nylon, spandex, other natural or synthetic elastomer/rubber materials, as well as various fabrics, including fabrics made from such polymers and/or other materials. As described above, the cover 20 may be made from a polymeric material, such as an elastomer, with a coating or backing of a fabric or another polymer. To decrease weight, at least a portion of the cover 20 may be formed of a foamed material, such as foamed neoprene or polyurethane. Such materials may be formed using any known technique, including various types of molding (including injection molding) or other polymer production techniques, as well as sewing, weaving, stitching, and other fabric production techniques, as well as other techniques. The material may also be connected to itself or other materials of the cover 20 by connecting techniques such as stitching, welding, bonding (e.g. adhesives), or other techniques, to achieve the desired shape.

Figure 36:
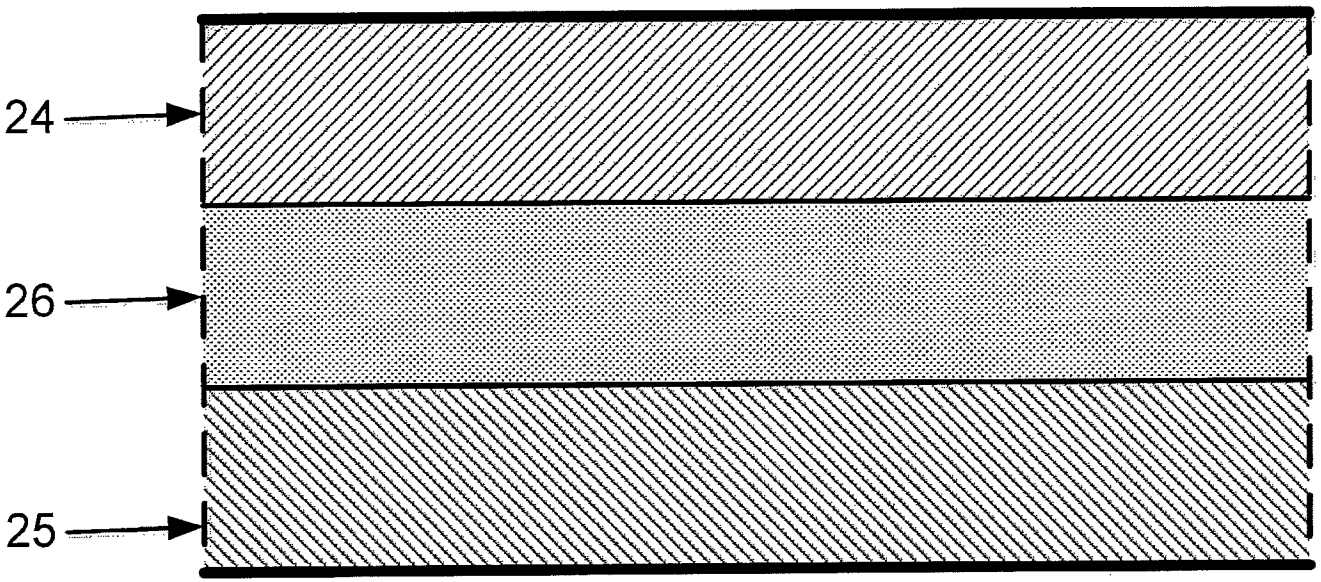
FIG. 36 is a schematic cross-sectional view showing a multi-layer material configured for use in a cover of a percussion striking device according to aspects of the present invention.

In one exemplary embodiment, as illustrated in FIG. 36, the cover 20 is formed of a multi-layer material that includes an outer fabric layer 24, an inner fabric layer 25, and a flexible cushioning layer 26 positioned between the inner and outer layers 24, 25. The outer fabric layer 24 may be made from a durable fabric material, such as a heavy nylon material (including Cordura in one example), to sustain impacts with the percussion instrument with limited or no damage. The inner fabric layer 25 may be made from a low-friction fabric material, such as a light nylon material, to ease insertion of the device 10 into the cavity 20. The cushioning layer 26 may be formed of an elastomeric or other flexible polymer material, including neoprene, polyurethane, and other such materials, which may have a foam or other cellular configuration. The cover 20 may be constructed so that the inner fabric layer 25 forms an inner surface of the cover 20 and lines the inner cavity 21, and the durable outer fabric layer 24 forms the outer surface of the cover 20. It is understood that any and all of the covers 20, 40, 60, 80, 90, 100 or any other covers within the scope of the present invention may be made from a material as described above and shown in FIG. 36.

The cover 20 may have one or more graphic features thereon, including one or more colors, patterns, or indicia such as a logo, label, name, initials, etc. In one embodiment, the cover 20 may be customizable graphically. For example, the cover 20 could be provided in a variety of colors or color combinations that can be selected by the user, such as school or team colors, and may likewise be available with selectable patterns and/or indicia. As another example, the cover 20 may have luminescent (e.g. glow-in-the-dark) or other stylistic indicia, patterns, or coloring. The cover 20 may be manufactured to include these graphic features, or the graphics may be applied after manufacturing, such as through paints, inks, coatings, dyes, labels, monograms, embroidering, etc. The material may be any color of choice to satisfy the look and also achieve satisfactory results for performance (i.e. stick height adjustments for drumlines, school colors, flashiness of soloists etc.).

The cover 20 may be provided in different material thicknesses to change the resulting effects. For example, thicker covers 20 may produce more muffled sound and more resistance to response, and thinner covers 20 may produce sound and feel that is closer to the full sound and feel of the uncovered device 10. Damage and wear resistance may also be affected by the thickness of the cover 20.

As described above, different embodiments of covers may be provided for different types of percussion striking devices, in addition to the cover 20 in FIGS. 1-3 that is configured for covering a drumstick 10. FIGS. 4-10 illustrate other embodiments of percussion striking devices 30, 50 and covers 40, 60 configured for covering the devices 30, 50.

Figure 4:
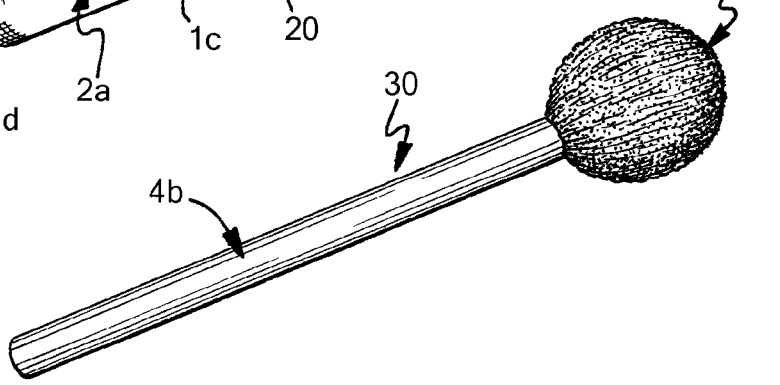
FIG. 4 is a perspective view of another illustrative embodiment of an existing percussion striking device.
Figure 5:
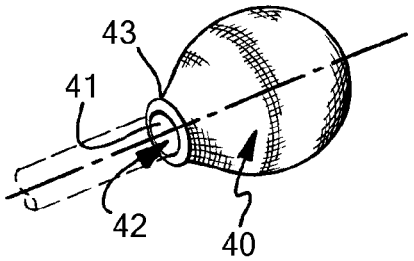
FIG. 5 is a perspective view of another illustrative embodiment of a cover for a percussion striking device according to aspects of the present invention, configured for use with the striking device of FIG. 4.
Figure 6:
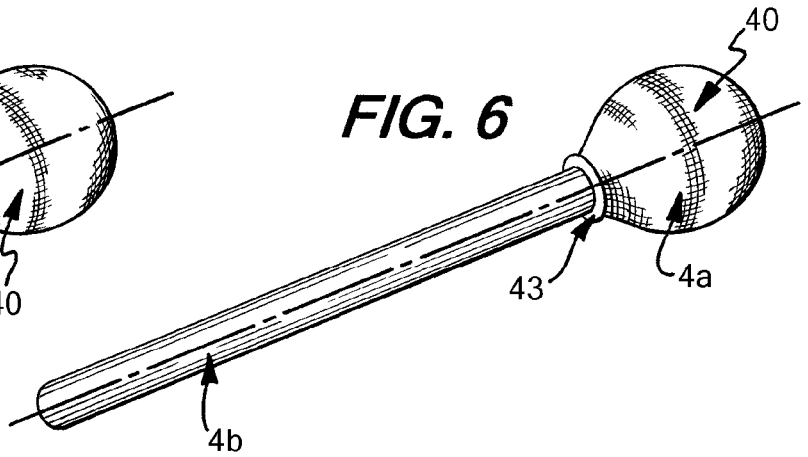
FIG. 6 is a perspective view of the cover of FIG. 5 disposed on the percussion striking device of FIG. 4.
Figure 11:
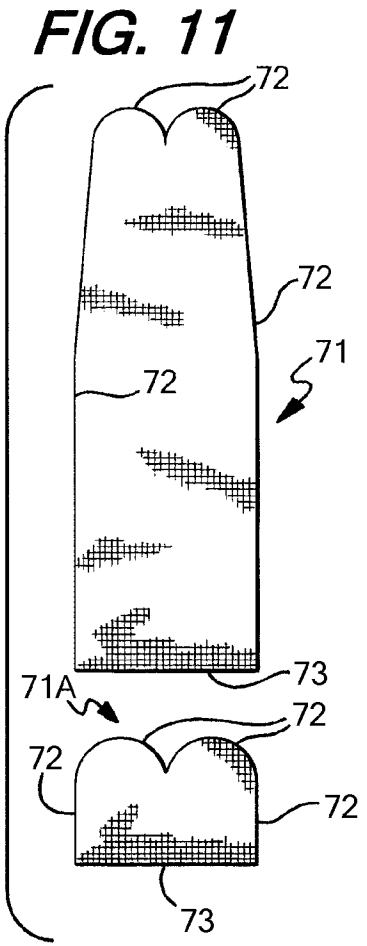
FIGS. 11-14 are plan views of illustrative embodiments of blanks that may be used to construct covers according to aspects of the present invention.
Figure 12:
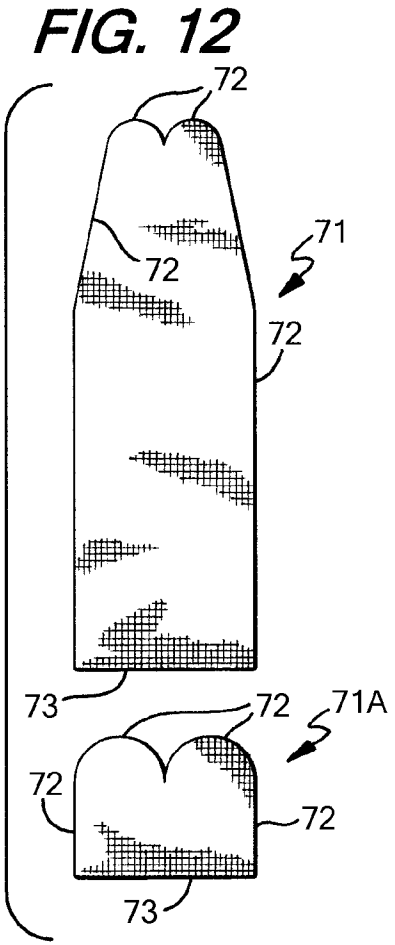
Figure 13:
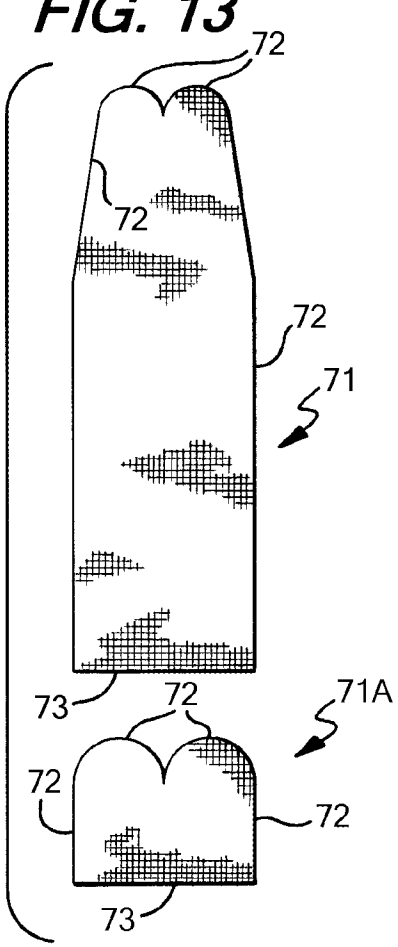

FIGS. 4-6 illustrate a percussion striking device 30 in the form of a yarn mallet or beater, such as for striking a marimba, vibraphone, or other key instrument. The device 30 of FIGS. 4-6 includes a shaft **4*b* and a striking portion in the form of an enlarged head 4*a* at one end of the shaft 4*b*. In this embodiment, the head 4*a* is formed of tightly wrapped yarn, and the shaft 4*b* is formed from wood or other rigid material. Other types of striking devices with enlarged heads 4*a*, having heads 4*a* and/or shafts 4*b*** made from different materials, may be utilized in connection with the invention. For example, other mallets or beaters may have heads made from or including rubber or felt.

FIG. 5 illustrates one embodiment of a cover 40 configured to be used in connection with the device 30 of FIG. 4, and FIG. 6 illustrates the cover 40 disposed on the device 30 of FIG. 4. In this embodiment, the cover 40 has a body that takes the form of a sleeve of material that includes an opening 42 that leads to an internal cavity 41 configured to receive a portion or portions of the device 30 therein. The cover 40 in this embodiment covers the entire head **4*a* of the device 30. The shaft 4*b* of the device 30 is left substantially uncovered in this embodiment. In other embodiments, the cover 40 may cover a different portion of the device 30, and a greater portion of the shaft 4*b* may be covered. The cover 40 also includes an elastic portion 43, such as an elastic band, connected around the opening 42. The elastic portion 43 is able to expand to allow the head 4*a* to be inserted into the opening 42, and then contracts to secure the cover 40 in place on the head 4*a*. In other embodiments, the cover 40 may include a different fastening structure for this purpose, such as a cinch, clamp, drawstring, etc. The cover 40 provides a soft and/or resilient surface on the head 4*a*, conferring some or all of the benefits described above with respect to the cover 20 in FIGS. 1-3. Any of the additional or alternate features described above with respect to the cover 20 of FIGS. 1-3 can be used in connection with the cover 40 of FIGS. 5-6. For example, a second piece to cover at least a portion of the shaft 4*b* may be provided. It is understood that the cover 40 of FIGS. 5-6**, or a similar cover, can be used with other types of mallets, beaters, or other striking devices having heads that are enlarged relative to the shaft.

FIGS. 7-10 illustrate a percussion striking device 50 in the form of a foot pedal beater, such as for striking a bass drum or similar percussion instrument. The device 50 of FIGS. 7-10 includes a shaft 51, a striking portion in the form of an enlarged head 52 at one end of the shaft 51, a stand 53 configured to support the shaft 51, and a pedal 54 operably connected to the shaft 51 and the stand 53. The pedal 54 is configured to be actuated by the user's foot, to cause the shaft 51 to swing and/or pivot on the stand 53 to move the head 52 to strike the percussion instrument. In this embodiment, the shaft, the stand, and the pedal 54 may be made of metal or another rigid material, and the head 52 may be made from a combination of materials, including metals, polymers, and fabrics such as felt. The head 52 in this embodiment has a generally cylindrical shape, with a rounded or cylindrical portion 55 and less rounded or flattened ends 56 on one or both ends of the cylindrical portion 55. The ends 56 of the head 52 may be considered striking portions, as the ends 56 are configured for striking the instrument. Other types of mechanically actuated striking devices with enlarged heads 52, or striking devices with substantially cylindrically-shaped heads 52, may be utilized in connection with the invention. Such other striking devices may be differently configured and/or made at least partially from different materials.

FIGS. 9-10 illustrate one embodiment of a cover 60 configured to be used in connection with the device 50 of FIGS. 7-8, in a position disposed on the device 50. In this embodiment, the cover 60 has a body that takes the form of two pieces or end caps 61 that each cover a portion or portions of the device 50 and receive portions of the device 50 therein. As shown in FIGS. 9-10, each piece 61 covers one of the two ends 56 of the head 52 of the striking device 50, and each piece 61 is cup-shaped with a cavity 63 that receives a portion of the respective end 56 of the head 52. Elastic straps 62 connect the two pieces 61. The straps 62 are able to expand to allow the pieces 61 to be stretched over the ends 56 and then contract to apply tension between the pieces 61 to secure the pieces 61 in place on the head 52. By covering both ends 56 of the head 52 of the device 50, the cover 60 does not need to be adjusted if the device 50 is reversed by the performer, as the other end 56 remains covered. In other embodiments, the cover 60 may cover a different portion of the device 50, such as by having larger or smaller pieces 61. In one embodiment, the cover 60 may not include straps 62, and may have one or more openings and/or slits that allow the cover 60 to be inserted over the head 52. The cover 60 may include an elastic portion in this embodiment as well. In further embodiments, the cover 60 may cover only one end 56 of the head 52, or may cover the entire head 52. The cover 60 provides a soft and/or resilient surface on the head 52, conferring some or all of the benefits described above with respect to the cover 20 in FIGS. 1-3. In the embodiment shown, the pieces 61 of the cover 60 are formed of a flexible material such as neoprene, similar to the cover 20 of FIGS. 1-3, however other materials can be used in other embodiments. Any of the additional or alternate features described above with respect to the cover 20 of FIGS. 1-3 can be used in connection with the cover 60 of FIGS. 9-10. It is understood that the cover 50 of FIGS. 9-10, or a similar cover, can be used with other types of mechanically actuated striking devices with enlarged heads 52, or striking devices with substantially cylindrically-shaped heads 52.

Figure 14:
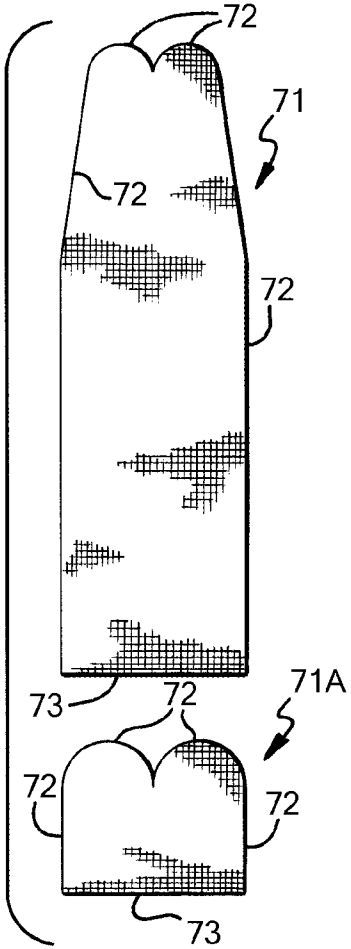
Figure 15:
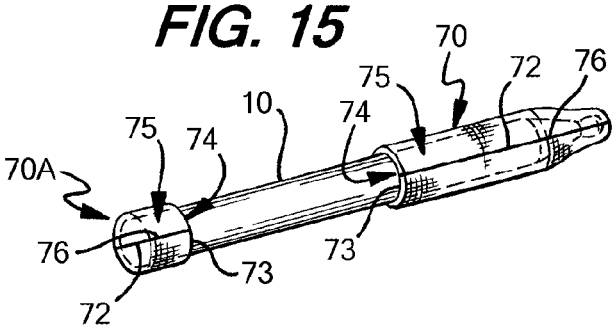
FIG. 15 is a side view of a percussion striking device as shown in FIG. 1, having another illustrative embodiment of a cover according to aspects of the present invention connected to the percussion striking device.
Figure 16:
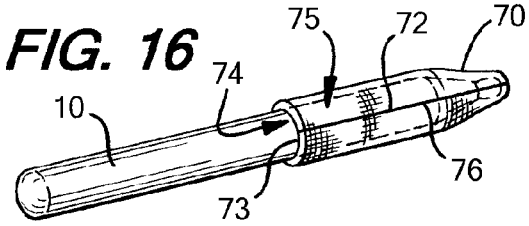
FIG. 16 is a side view of a percussion striking device as shown in FIG. 1, having another illustrative embodiment of a cover according to aspects of the present invention connected to the percussion striking device.
Figure 20:
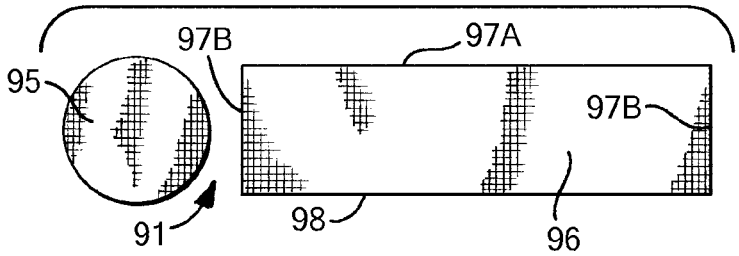
Figure 21:
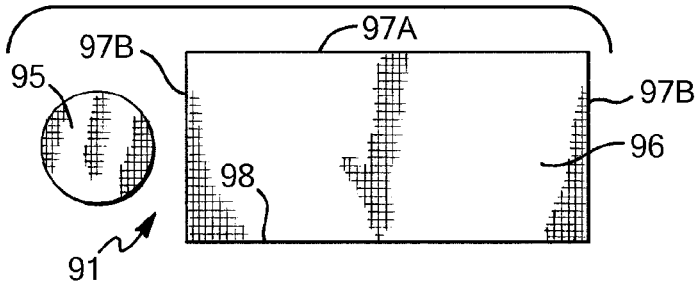
Figure 22:
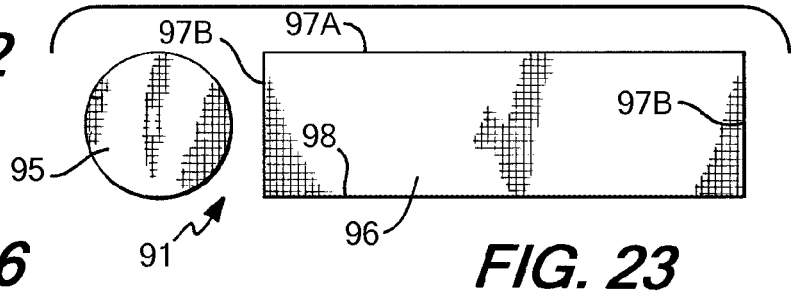

In one embodiment, a cover as described herein may be formed of one or more pieces of a flexible material that are connected together to define the body of the cover, such as by stitching, adhesive, or other technique. Blanks of the flexible material may be used to form such covers. FIGS. 11-14 illustrate examples of blanks 71 that may be used to form covers similar to the cover 20 of FIGS. 2-3. The blanks 71 of FIGS. 11-14 are configured for use with different size devices 10, decreasing in size from largest (FIG. 11) to smallest (FIG. 14). FIGS. 15 and 16 illustrate examples of covers 70 formed using these blanks 71. Each of the blanks 71 of FIGS. 11-14 is configured to be wrapped to form an internal cavity 75 of the cover 70, and has connection sides 72 that are configured to be connected to each other (e.g. by stitching). The seams 76 formed by these connection sides 72 are illustrated in FIGS. 15 and 16. The blanks 70 also have free ends 73 that are not configured to be connected, forming the opening 74 of the cover 70. The blanks 71A are configured for forming the second piece or second cover 70A as shown in FIG. 15. The covers 70, 70A of FIGS. 15-16 generally include other structural features that are the same or similar to the structural features of the cover(s) 20 of FIGS. 2-3, and such shared structural features are not described herein for the sake of brevity.

Figure 17:
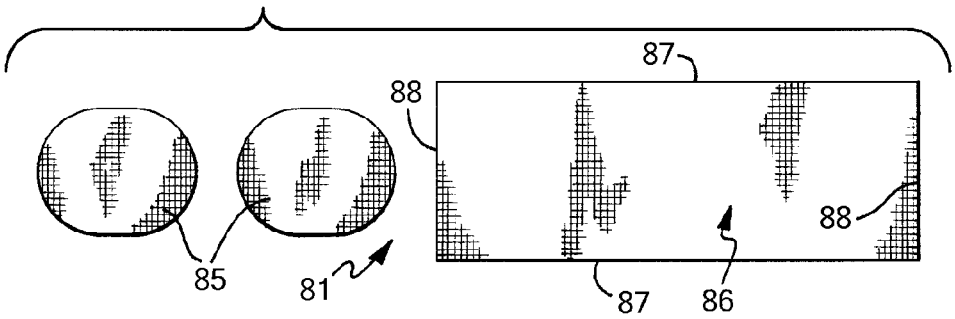
FIGS. 17-26 are plan views of illustrative embodiments of blanks that may be used to construct covers according to aspects of the present invention.
Figure 18:
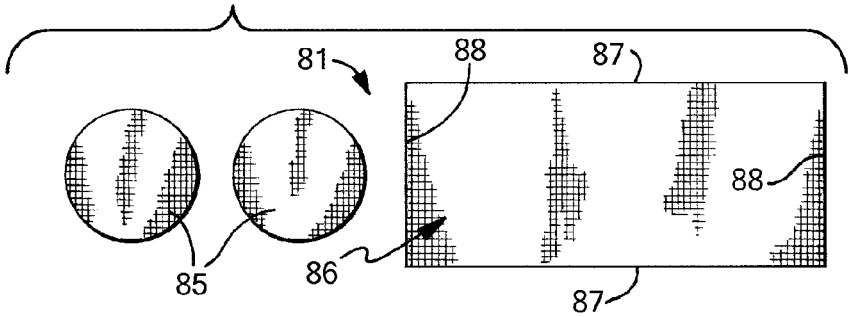
Figure 31:
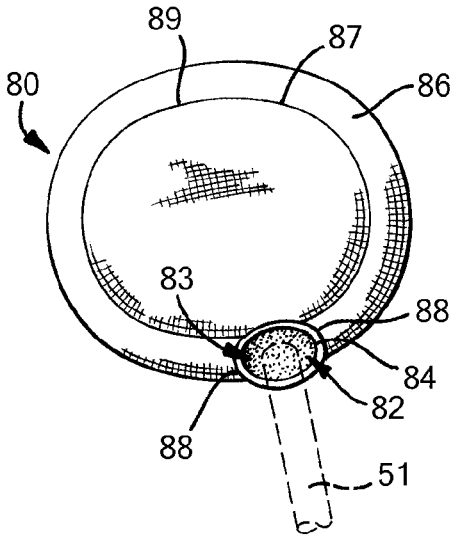
FIG. 31 is a bottom-front perspective view of another illustrative embodiment of a cover according to aspects of the present invention, configured to cover at least a portion of the head of the percussion striking device as shown in FIG. 8.
Figure 32:
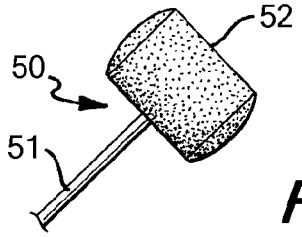
FIG. 32 is a side view of a head of a striking device as shown in FIG. 8.
Figure 33:
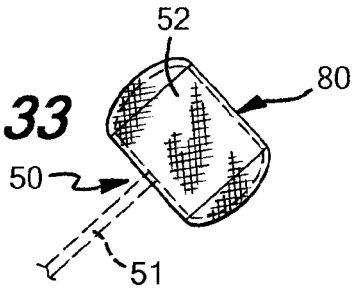
FIG. 33 is a side view of another illustrative embodiment of a cover according to aspects of the present invention, configured to be removably connected to the head of the percussion striking device of FIG. 32.
Figure 35:
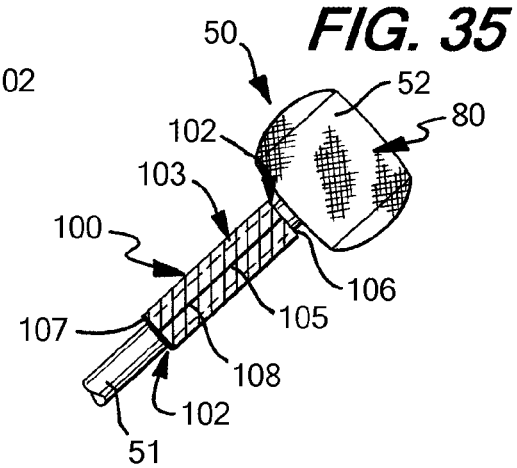
FIG. 35 is a side view of the percussion striking device of FIG. 32 having the covers of FIGS. 33 and 34 removably connected to the percussion striking device.

FIGS. 17-18 illustrate examples of blanks 81 that may be used to form covers such as the cover 80 shown in FIGS. 28-31. FIGS. 33 and 35 also show embodiments of this cover 80. The cover 80 of FIGS. 28-31 is configured for use with a striking device 50 as shown in FIG. 7 and described above. The cover 80 in this embodiment has a body that takes the form of a sleeve of material that includes an opening 82 that leads to an internal cavity 83 configured to receive a portion or portions of the device 50 therein. The cover 80 in this embodiment covers the entire head 52 of the device 50. The shaft 51 of the device 50 is left substantially uncovered in this embodiment. In other embodiments, the cover 80 may cover a different portion of the device 50, and a greater portion of the shaft 51 may be covered. The cover 80 may also include an elastic portion 84, such as an elastic band, connected around the opening 82, such as shown in FIG. 31. The elastic portion 84 is able to expand to allow the head 52 to be inserted into the opening 82, and then contracts to secure the cover 80 in place on the head 52. In other embodiments, the cover 80 may include a different fastening structure for this purpose, such as a cinch, clamp, drawstring, etc. The cover 80 provides a soft and/or resilient surface on the head 52, conferring some or all of the benefits described above with respect to the cover 20 in FIGS. 1-3. Any of the additional or alternate features described above with respect to the covers 20, 40, 60 as described above can be used in connection with the cover 80 of FIGS. 28-31. For example, a second piece to cover at least a portion of the shaft 51 may be provided. It is understood that the cover 80 of FIGS. 28-31, or a similar cover, can be used with other types of mallets, beaters, or other striking devices having heads that are enlarged relative to the shaft. As one specific example, the cover 80 may be used in connection with a beater that has a shaft 51 and head 52 similar to the device 50 of FIG. 7, but having a hand-held configuration. The covers 80 of FIGS. 28-31 may include other structural features that are the same or similar to the structural features of the covers 20, 40, 60 described above, and such shared structural features are not described herein for the sake of brevity.

As described above, the blanks 81 of FIGS. 17-18 may be used to form a cover 80 as shown in FIGS. 28-31 or a similar cover. The blanks 81 in this embodiment include two side pieces 85, which may be circular (FIG. 18), oval (FIG. 17), or another shape, and a central piece 86 connected to the two side pieces 85. The central piece 86 includes two connection sides 87 for connection around at least a portion of the perimeters of the side pieces 85, and ends 88 that are configured to form the opening 82. FIGS. 28-31 illustrate one such configuration, with seams 89 at the connections between the side pieces 85 and the central piece 86. As shown in FIG. 31, at least a portion of the ends 88 and/or the edges of the side pieces 85 may be connected to the elastic portion 84 in one embodiment. In one example embodiment, the central piece 86 in FIG. 17 may have a length (along connection sides 87) of 5½" and a width (along ends 88) of 2". In one example embodiment, the central piece 86 in FIG. 18 may have a length (along connection sides 87) of 4¾" and a width (along ends 88) of 2", and the side pieces 85 may have diameters of 1⁹⁄₁₆" each. It is understood that these embodiments are examples, and any desired sizes may be used for such components.

FIGS. 19-25 illustrate examples of blanks 91 that may be used to form covers such as the cover 90 shown in FIGS. 27A-B. The cover 90 of FIGS. 27A-B is configured for use with a striking device 30 as shown in FIG. 4 and described above, or another device with a similarly shaped head (e.g. a tympani or bass drum beater). The cover 90 in this embodiment has a body that takes the form of a sleeve of material that includes an opening 92 that leads to an internal cavity 93 configured to receive a portion or portions of the device 30 therein. The cover 90 in this embodiment covers the entire head 4*a* of the device 30. The shaft 4*b* of the device 30 is left substantially uncovered in this embodiment. In other embodiments, the cover 90 may cover a different portion of the device 30, and a greater portion of the shaft 4*b* may be covered. The cover 90 may also include an elastic portion 94, such as an elastic band, connected around the opening 92. The elastic portion 94 is able to expand to allow the head 4*a* to be inserted into the opening 92, and then contracts to secure the cover 90 in place on the head 4*a*. In other embodiments, the cover 90 may include a different fastening structure for this purpose, such as a cinch, clamp, drawstring, etc. The cover 90 provides a soft and/or resilient surface on the head 4*a*, conferring some or all of the benefits described above with respect to the cover 20 in FIGS. 1-3. Any of the additional or alternate features described above with respect to the covers 20, 40, 60, 80 as described above can be used in connection with the cover 90 of FIGS. 27A-B. For example, a second piece to cover at least a portion of the shaft 4*b* may be provided. It is understood that the cover 90 of FIGS. 27A-B, or a similar cover, can be used with other types of mallets, beaters, or other striking devices having heads that are enlarged relative to the shaft. The covers 90 of FIGS. 27A-B may include other structural features that are the same or similar to the structural features of the covers 20, 40, 60, 80 described above, and such shared structural features are not described herein for the sake of brevity.

As described above, the blanks 91 of FIGS. 19-25 may be used to form a cover 90 as shown in FIGS. 27A-B or a similar cover. The blanks 91 in this embodiment include an end piece 95, which may be circular or another shape, and a sleeve piece 96 connected to the end pieces 95. The sleeve piece 96 includes an end connection side 97A for connection around the perimeter of the end piece 95, connection sides 97B configured for connection to each other to form a cylindrical sleeve, and an end 98 that is configured to form the opening 92. FIGS. 27A-B illustrate one such configuration, with seams 99 at the connections between the end connection side 97A and the end piece 95, and at the connection between the connection sides 97B of the central piece 86. As shown in FIGS. 27A-B, at least a portion of the end 88 may be connected to the elastic portion 94 in one embodiment.

Figure 19:
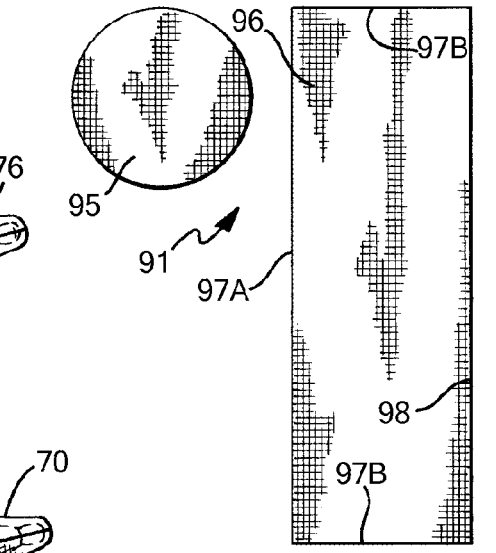

In one example embodiment, the blank 81 of FIG. 19 may be used to make a cover for a bass drum beater, with the central piece 96 in FIG. 19 having a length (along end 98) of 6⅛" and a width (along connection sides 97B) of 2", and with the side piece 95 having a diameter of 2" or 1⅞". In one example embodiment, the blank 81 of FIG. 20 may be used to make a cover for a tympani beater, with the central piece 96 in FIG. 20 having a length (along end 98) of 5" and a width (along connection sides 97B) of 1⅜", and with the side piece 95 having a diameter of 1 9/16". In one example embodiment, the blank 81 of FIG. 21 may be used to make a cover for a marimba or other yarn beater, with the central piece 96 in FIG. 21 having a length (along end 98) of 4¼" and a width (along connection sides 97B) of 2", and with the side piece 95 having a diameter of 1⅛" or 1¼". In one example embodiment, the blank 81 of FIG. 22 may be used to make a cover for a percussion beater, with the central piece 96 in FIG. 22 having a length (along end 98) of 5" and a width (along connection sides 97B) of 1½", and with the side piece 95 having a diameter of 1 9/16" or 1½". In one example embodiment, the blank 81 of FIG. 23 may be used to make a cover for a yarn beater, with the central piece 96 in FIG. 23 having a length (along end 98) of 4½" and a width (along connection sides 97B) of 1½", and with the side piece 95 having a diameter of 1 7/16" or 1⅜". In one example embodiment, the blank 81 of FIG. 24 may be used to make a cover for a percussion beater, with the central piece 96 in FIG. 24 having a length (along end 98) of 4⅛" and a width (along connection sides 97B) of 1⅛", and with the side piece 95 having a diameter of 1⅛". In one example embodiment, the blank 81 of FIG. 25 may be used to make a cover for a percussion beater, with the central piece 96 in FIG. 25 having a length (along end 98) of 5¾" and a width (along connection sides 97B) of 1¾", and with the side piece 95 having a diameter of 1½" or 1¾". It is understood that these embodiments are examples, and any desired sizes may be used for such components.

Figure 26:
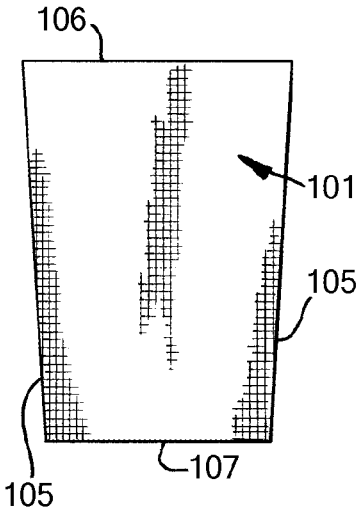
Figure 23:
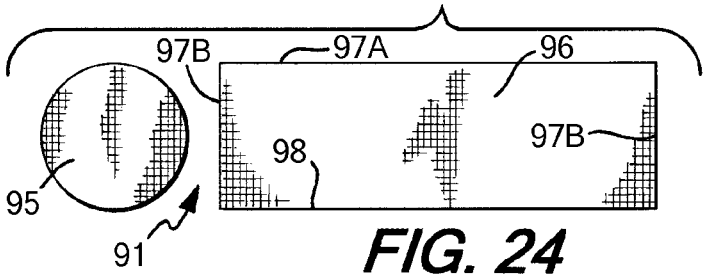
Figure 24:
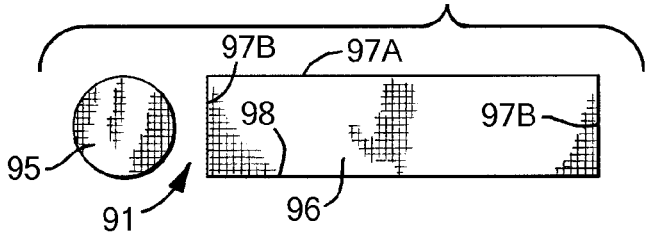
Figure 25:
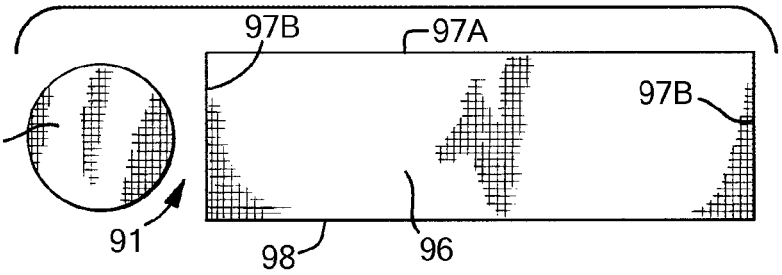
Figure 30:
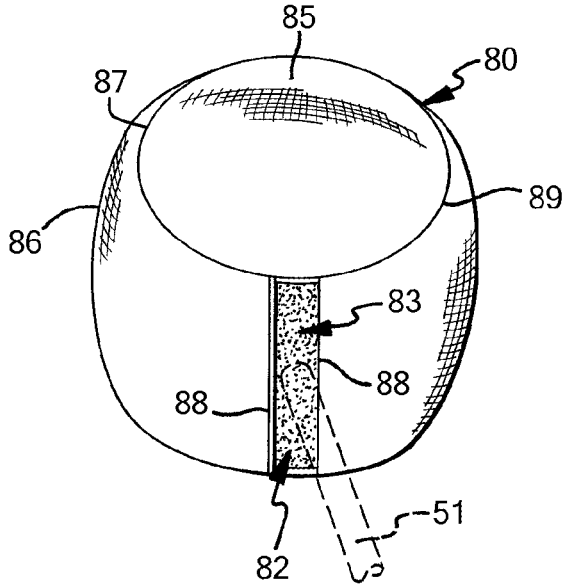
FIG. 30 is a bottom-front-right perspective view of the cover of FIG. 28.
Figure 34:
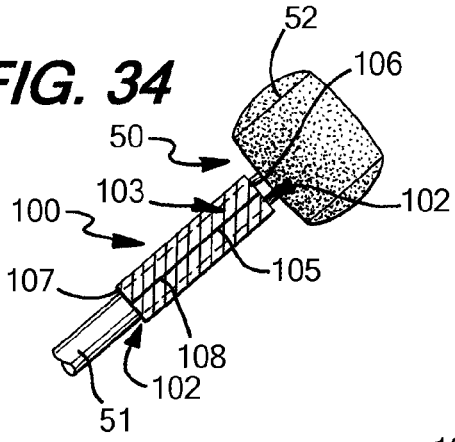
FIG. 34 is a side view of another illustrative embodiment of a cover according to aspects of the present invention, configured to be removably connected to a shaft of the percussion striking device of FIG. 32.

FIG. 26 illustrates an examples of a blanks 101 that may be used to form covers such as the cover 100 shown in FIGS. 34-35. The cover 100 of FIG. 26 is configured for use with a striking device 50 as shown in FIG. 7 and described above, but could be used to cover a portion of the shaft of any percussion device if appropriately dimensioned. The cover 100 in this embodiment has a body that takes the form of a sleeve of material that includes two end openings 102 that lead to an internal cavity 103 configured to receive a portion or portions of the shaft 51 of the device 50 therein and to cover a portion of the shaft 51 the device 50. In other embodiments, the cover 100 may cover a different portion of the shaft 51, such as the entire shaft 51. The cover 100 may also include an elastic portion (not shown), such as an elastic band, connected around either or both openings 102. In other embodiments, the cover 100 may include a different fastening structure for this purpose, such as a cinch, clamp, drawstring, etc. The cover 100 provides a soft and/or resilient surface on the shaft 51, conferring some or all of the benefits described above with respect to the cover 20 in FIGS. 1-3, and further provides cushioning for the shaft 51 during rim strikes or other strikes on the shaft 51 of the device 50. The cover 100 may include an outer surface that is made from a material with very high durability, such as Cordura (as described above with respect to FIG. 36), as the cover 100 may sustain significant stresses during use. Any of the additional or alternate features described above with respect to the covers 20, 40, 60, 80, 90 as described above can be used in connection with the cover 100 of FIGS. 34-35. For example, the cover 100 may be used in conjunction with a second piece to cover at least a portion of the head 52. FIGS. 33 and 35 illustrate the use of the cover 100 with a cover 80 as shown in FIGS. 28-31 covering the head 52. It is understood that the cover 100 of FIGS. 34-35, or a similar cover, can be used with other types of mallets, beaters, or other striking devices. The cover 100 of FIGS. 33-34 may include other structural features that are the same or similar to the structural features of the covers 20, 40, 60, 80, 90 described above, and such shared structural features are not described herein for the sake of brevity.

As described above, the blank 101 of FIG. 26 may be used to form a cover 100 as shown in FIGS. 33-34 or a similar cover. The blank 101 in this embodiment connection sides 105 configured for connection to each other to form a cylindrical sleeve, and ends 106, 107 that are configured to form the openings 102. FIGS. 33-34 illustrate one such configuration, with seams 108 at the connections between the connection sides 105. In one embodiment, the blank 101 of FIG. 26 may have a trapezoidal shape, with the end 106 having a larger dimension than the opposite end 107. In an example embodiment, the blank 101 of FIG. 26 may have one end 106 with a length of 2¾" and the opposite end 107 with a length of 2⅜". It is understood that this embodiment is an example, and any desired sizes may be used for such components.

Further embodiments of striking devices may be used in connection with the covers described herein, and similar or different covers may be designed for such other striking devices. It is understood that some embodiments of striking devices may not include an identifiable head and, for example, may have a portion of a shaft serving as a striking portion, such as a straight cylindrical stick or rod. The covers 20, 40, 60, 80, 90, 100 described above, and other embodiments of covers, can be constructed or modified to cover any size, type, or configuration of percussion striking device, in accordance with aspects of the invention. In creating such additional embodiments or configurations, several components, options, or features of the embodiments described above may be combined or modified to adapt to the particular configuration of the striking device desired to be covered. Any and all such embodiments are within the scope of the present invention.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A cover for a percussion striking device having a shaft and a striking portion configured for striking a percussion instrument, the cover comprising:

a body made of a flexible material and defining an internal cavity, wherein the cover is configured to be removably connected to the percussion striking device such that at least a portion of the percussion striking device is received within the internal cavity and the striking portion is covered by the flexible material, wherein the body comprises a first piece and a second piece that are separate from each other and are connected by at least one elastic strap, wherein the cover is configured to be connected to an enlarged head of the percussion striking device such that the first and second pieces are positioned on opposite sides of the head, and wherein the cover is configured to be removed from the percussion striking device by removing the at least a portion of the percussion striking device from the internal cavity.

2. The cover of claim 1, wherein the flexible material is a multi-layer material comprising a smooth fabric layer on an inner surface facing the internal cavity, a durable fabric layer on an outer surface opposite the inner surface, and a flexible cushioning layer between the smooth fabric layer and the durable fabric layer.

3. The cover of claim 2, wherein the flexible cushioning layer comprises a polymer material with a cellular structure.

4. The cover of claim 2, wherein the three-layer material has a thickness of between about 1-3 mm.

5. The cover of claim 2, wherein the flexible cushioning layer comprises a sound absorbent and energy absorbent material.

6. The cover of claim 1, wherein the first and second pieces are cup-shaped and each have an internal cavity configured to receive a portion of the head of the percussion striking device.

7. The cover of claim 1, wherein the body has at least one customizable graphic feature.

8. An assembly comprising:

a percussion striking device comprising a drumstick having an elongated, generally cylindrical shaft with a narrowed tip at one end and a butt end opposite the narrowed tip, the narrowed tip having a striking portion configured for striking a percussion instrument; and a cover comprising a body made of a flexible material and defining an internal cavity, wherein the body comprises an elongated cylindrical sleeve having an open end defining an opening providing access to the internal cavity and a closed end opposite the open end, the cover being removably connected to the percussion striking device by inserting the narrowed tip and a portion of the shaft through the opening and into the internal cavity, such that the narrowed tip and the portion of the shaft of the percussion striking device are received within the internal cavity, and the shaft has an exposed portion that is not received within the internal cavity and is configured for gripping by a user, wherein the narrowed tip and the striking portion are covered by the closed end of the body, wherein the flexible material is a multi-layer material comprising a smooth fabric layer on an inner surface facing the internal cavity, a durable fabric layer on an outer surface opposite the inner surface, and a flexible cushioning layer between the smooth fabric layer and the durable fabric layer, and wherein the sleeve is fitted closely to the shaft to removably secure the cover on the percussion striking device by frictional engagement between the smooth fabric layer and the percussion striking device, wherein the cover is configured to muffle a sound produced by striking the percussion instrument with the percussion striking device, relative to the device without the cover, and wherein the cover is formed of a flat blank of the multi-layer material that is wrapped to form the internal cavity, with opposed sides of the blank connected to each other along a seam.

9. The assembly of claim 8, wherein the percussion striking device further comprises a second striking portion at the butt end, the assembly further comprising a second cover comprising a second body made of the flexible material and defining a second internal cavity, the second body having a second open end defining a second opening providing access to the second internal cavity and a second closed end opposite the second open end, the second cover being removably connected to the percussion striking device by inserting the butt end and at least a portion of the shaft through the second opening and into the second internal cavity, such that the butt end and at least a second portion of the shaft of the percussion striking device are received within the second internal cavity, and the butt end and the second striking portion are covered by the second closed end of the second body, and wherein the second sleeve is fitted closely to the shaft to removably secure the second cover on the percussion striking device by frictional engagement between the smooth fabric layer and the percussion striking device.

10. A cover for a percussion striking device having a shaft and a striking portion configured for striking a percussion instrument, the cover comprising:

a body made of a flexible material and defining an internal cavity, wherein the cover is configured to be removably connected to the percussion striking device such that at least a portion of the percussion striking device is received within the internal cavity and the striking portion is covered by the flexible material, wherein the body comprises a first piece and a second piece that are separate from each other and are connected by at least one elastic strap, wherein the cover is configured to be connected to an enlarged head of the percussion striking device such that the first and second pieces are positioned on opposite sides of the head, and wherein the first and second pieces are cup-shaped and each have an internal cavity configured to receive a portion of the head of the percussion striking device.

* * * * *